United States Patent [19]

Whitefield

[11] 4,444,082

[45] Apr. 24, 1984

[54] MODIFIED TRANSIENT HARMONIC INTERPOLATOR FOR AN ELECTRONIC MUSICAL INSTRUMENT

[75] Inventor: John T. Whitefield, Harleysville, Pa.

[73] Assignee: Allen Organ Company, Macungie, Pa.

[21] Appl. No.: 432,583

[22] Filed: Oct. 4, 1982

[51] Int. Cl.[3] ..... G10H 1/057; G10H 1/08

[52] U.S. Cl. ..... 84/1.21; 84/1.13; 84/1.22; 84/1.26

[58] Field of Search ..... 84/1.11–1.13, 84/1.19–1.24, 1.26

[56] References Cited

U.S. PATENT DOCUMENTS

| | | | |
|---|---|---|---|
| 3,610,805 | 10/1971 | Watson | 84/1.13 |
| 3,809,789 | 5/1974 | Deutsch | 84/1.01 |
| 4,085,644 | 4/1978 | Deutsch et al. | 84/1.01 |
| 4,132,140 | 1/1979 | Chibana | 84/1.11 |
| 4,138,915 | 2/1979 | Nagai et al. | 84/1.22 |
| 4,142,432 | 3/1979 | Kameyama et al. | 84/1.01 |
| 4,184,403 | 1/1980 | Whitefield | 84/1.11 |
| 4,205,575 | 6/1980 | Hoskinson et al. | 84/1.01 |
| 4,224,856 | 9/1980 | Ando et al. | 84/1.19 |
| 4,227,433 | 10/1980 | Chibana | 84/1.01 |
| 4,227,435 | 10/1980 | Ando et al. | 84/1.19 |
| 4,352,312 | 10/1982 | Whitefield et al. | 84/1.21 |

*Primary Examiner*—Stanley J. Witkowski
*Attorney, Agent, or Firm*—Sanford J. Piltch

[57] ABSTRACT

A method and apparatus for interpolating between the harmonic structures of a waveform stored in memory during portions or the entire transient periods of said waveform. In an electronic musical instrument having a greater number of selectively actuable switches than note generators to cause the production of sounds corresponding to the respective notes of a musical scale, the present invention interpolates between the harmonic structures of a waveform stored in memory during portions or the entire transient periods of said waveform. This is accomplished through the use of memory units having a number of locations or zones within each memory where the number of zones is equivalent to the number of discrete harmonic structures. The first of the memory units contains a discrete fixed harmonic structure in each of its zones, and a second of the memory units contains a difference value in each of its zones where the difference value is equal to the difference between the discrete fixed harmonic structure in adjacent zones of the first memory. Each of the memory units is addressed by a means for controlling the length of time of the interpolation between harmonic structures of a waveform during the transient periods of said waveform for selectively causing the reading out from each said memory the respective values therein which are converted to an analog current and scaled to provide correlating magnitudes so that the converted and scaled voltages may be summed to form the interpolated harmonic structures of the waveform. These interpolated harmonic structures are then scaled by a waveform envelope and fed into an audio amplifier for reproducing the waveform as audible sound through a suitable sound transducing device. The different transient periods of the waveform are detected by this scheme and cause either an attack or a decay type waveform to be generated. The length of time of the interpolation between harmonic structures is specifically controlled and may occur as either a linear or non-linear sequence occupying either the entire transient period or a shortened portion thereof.

24 Claims, 12 Drawing Figures

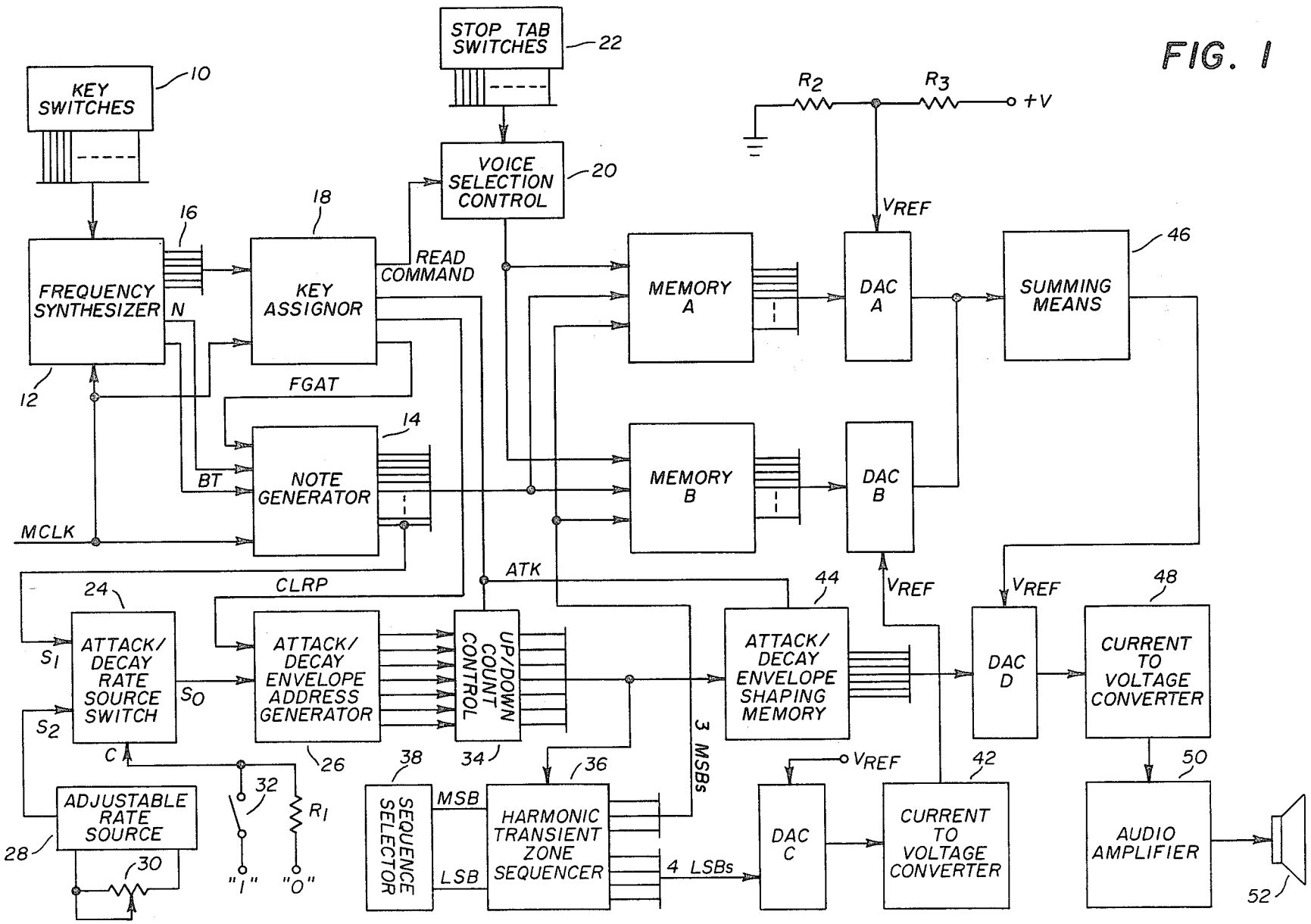
FIG. 1
KEY SWITCHES
10
FREQUENCY SYNTHESIZER
12
16
N
MCLK
STOP TAB SWITCHES
22
VOICE SELECTION CONTROL
20
READ COMMAND
KEY ASSIGNOR
18
FGAT
NOTE GENERATOR
14
BT
CLRP
R2
R3
+V
VREF
DAC A
DAC B
MEMORY A
MEMORY B
SUMMING MEANS
46
ATTACK/ DECAY ENVELOPE SHAPING MEMORY
44
ATTACK/ DECAY ENVELOPE ADDRESS GENERATOR
26
ATTACK/ DECAY RATE SOURCE SWITCH
24
S1
S2
S0
C
ADJUSTABLE RATE SOURCE
30
28
R1
32
"0"
"1"
ATK
UP/DOWN COUNT CONTROL
34
3 MSBs
4 LSBs
HARMONIC TRANSIENT ZONE SEQUENCER
36
MSB
LSB
SEQUENCE SELECTOR
38
DAC C
DAC D
CURRENT TO VOLTAGE CONVERTER
42
CURRENT TO VOLTAGE CONVERTER
48
AUDIO AMPLIFIER
50
52

MODIFIED TRANSIENT HARMONIC INTERPOLATOR FOR AN ELECTRONIC MUSICAL INSTRUMENT

BACKGROUND OF THE INVENTION

Most, if not all, musical instruments produce varying degrees of harmonic change with time as they are played. Some instruments exhibit this change during the onset of tone production, and then settle down harmonically to a "steady state" condition. Examples of such instruments would be horns, bowed strings, and organ pipes. There are other instruments where the harmonic change occurs throughout the audible sound production. Examples of these would be plucked strings, bells, and piano-type instruments. In synthesizing the sounds of musical instruments electronically, harmonic changes with time are an important contribution to realism.

In presently manufactured electronic musical instruments, harmonic variations with time have been implemented with varying degrees of success. One such approach is described in U.S. Pat. No. 4,184,403, assigned to the assignee of the present invention wherein waveform generation is accomplished by successively reading out amplitude samples of a waveform from a memory. The harmonic content of the voice of audible tone being generated is caused to change by reading from multiple memories, singly but in sequence, where each memory contains a slightly different harmonic content. The major deficiency in producing audible tones in the manner just described is the fact that under certain circumstances, such as a long, gradual decay, it becomes apparent to the listener that a sequence of discrete harmonic structures is being generated as opposed to a smooth gradually changing harmonic sequence. In a co-pending application entitled Transient Harmonic Interpolation for an Electronic Musical Instrument, invented by J. T. Whitefield and R. P. Woron, Ser. No. 272,223, filed June 10, 1981, and now U.S. Pat. No. 4,352,312, the major deficiency explained above was eliminated. However, this approach, along with the approach of U.S. Pat. No. 4,184,403, are such that the frequency of harmonic change or, in other words, the harmonic change per unit time, is uniform throughout the entire harmonic sequence and thus are subject to the size of the harmonic waveform memory. That is to say that twice as much change per unit time implies a need for twice as much memory space.

It is therefore an object of the present invention to eliminate the constraints of uniformity of the sequence of discrete harmonic structures by causing the transient harmonic interpolation to occur over a period of time less than the total transient time.

It is another object of the present invention to be able to cause the transient harmonic interpolation to occur over the entire transient period but in a non-linear fashion so that the degree of interpolation at different times during, for example, percussive decay, can be specifically tailored for that period of the tone.

Other objects will appear hereinafter.

SUMMARY OF THE INVENTION

In certain kinds of acoustic musical instruments such as guitar, mandolin, and harpsichord where strings are plucked, and to some degree in a piano where the strings are struck, the greatest amount of harmonic change is observed to be at the beginning of the transient period while toward the end little harmonic change can be detected. Two factors are working together to create this impression on the listener. First, the string having been just plucked or struck will initially cause harmonic instability which gradually becomes less and less with time. Secondly, as time passes, the sound level drops to such a degree that eventually that level becomes low enough that subtle changes in the harmonic content that do exist are not easily perceived or detected.

The above objectives may be achieved by interposing a signal processing unit for converting the address line output of the count control to the memories described in the aforementioned patent application. This address processing unit is capable of controlling the degree of harmonic change per unit time without the need to increase the size of the harmonic waveform memories. It does not change any of the functions of the harmonic waveform memories. It only controls the time period during which the different harmonic structures in the waveform memories are caused to be read out of memory.

The present invention functions to cause the interpolation between harmonic structures of a waveform stored in memory during portions of the entire transient periods of said waveform. In an electronic musical instrument or electronic organ having a greater number of selectively actuable switches than note generators to cause the production of sounds corresponding to the respective notes of a musical scale to interpolate between harmonic structures of a waveform stored in memory during portions or the entire transient period of said waveform comprising the following. The memory comprises at least first and second memories having a number of locations or zones in each memory where the number of said zones is equivalent to the number of harmonic structures contained therein. In the first memory there is contained in each zone a fixed harmonic structure, while in the second memory there is contained in each zone a difference value equal to the difference between the fixed harmonic structures in adjacent zones of the first memory. A means for controlling the length of time of the interpolation between the harmonic structures of a waveform during the transient periods of said waveform generates addresses for selectively causing the reading out from each of the memories the contents of each zone in accordance with the output of the means for controlling the length of time of the interpolation. The upper segment of the output of the means for controlling the length of time of the interpolation is the memory zone address which selectively controls the scaling of the difference values read out from each zone of the memory by a digital to analog converting means. The lower segment of the output of the means for controlling the length of time of the interpolation is the digital to analog converting means address. A means for converting and scaling the fixed harmonic structures reads out of a selected zone of the first memory the harmonic structure which is then scaled by a fixed value. A means for converting and scaling the difference value reads out of a selected zone of the second memory the difference value which is scaled by a variant factor according to the current value of the lower segment of the output of the means for controlling the length of time of the interpolation. A summing means combines the converted and scaled fixed harmonic structures read out of the selected zones of the first memory with the converted and scaled difference values read out of the selected zones of the second memory and another means which converts and scales the generated transient waveform envelope by a scaling factor in accordance with the output of the summing means. Finally, an amplifying means produces the interpolated transient harmonic structures of the waveform as sound through an audio transducing means.

The means for controlling the length of time of the interpolation between the harmonic structures of a waveform comprises a means for detecting the transient period of the harmonic structure of a waveform where said transient period is either an attack or a decay period, a means for generating either a monotonically increasing address during an attack period or a monotonically decreasing address during a decay period and a means for selectively controlling the sequence of the interpolation between harmonic structures of the waveform during the transient periods. The means for selectively controlling the sequence of the interpolation between harmonic structures of the waveform comprises a switching means for generating a control code which designates which of the sequences of interpolation have been selected and an address processing means for interpreting the generated address and selectively controlling the memory zone address and the digital to analog converting means address in accordance with the sequence control code. Such address processing means may be a separate storage means such as a ROM or an EPROM which is selectively programmed by the organ designer to accomplish the same function. The sequence control code is preferably a two bit binary code for designating which of the four presently contemplated sequence modes is desired.

In accordance with the above, the upper segment of the output of the means for controlling the length of time of the interpolation comprises the three most significant bits of the output. Similarly, the lower segment of the output of the means for controlling the length of time of the interpolation comprises the four least significant bits of the output.

BRIEF DESCRIPTION OF THE DRAWINGS

For the purpose of illustrating the invention, there are shown in the drawings forms which are presently preferred; it being understood, however, that the invention is not limited to the precise arrangements and instrumentalities shown.

FIG. 1 is a schematic diagram, in the form of a block diagram, of an electronic musical instrument embodying an apparatus for interpolating transient harmonic structures in accordance with the present invention.

DETAILED DESCRIPTION OF THE INVENTION

Figure 2:
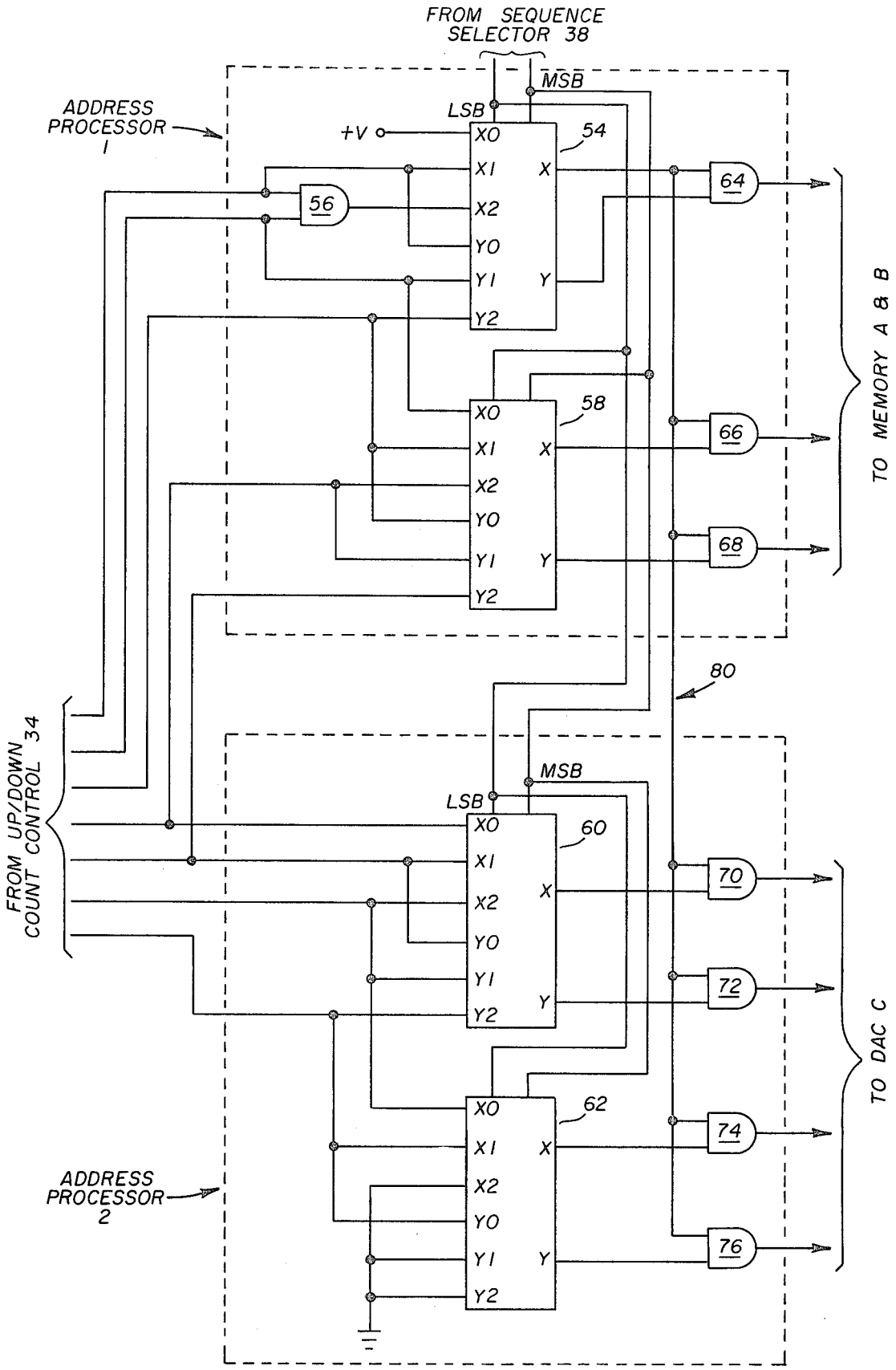
FIG. 2 is a logic diagram of one embodiment of the address processing means of the present invention.

The following detailed description is of the best presently contemplated modes of carrying out the present invention. This description is not intended in a limiting sense, but is made solely for the purpose of illustrating the general principles of the invention.

Referring now to the drawings in detail, wherein like numerals indicate like elements, there is shown in FIG. 1 a schematic diagram, in block form, of an electronic musical instrument embodying the present invention. An electronic musical instrument or digital electronic musical instrument in which the present invention may be applied and used is described in detail in U.S. Pat. Nos. 3,610,799 and 3,639,913 which are assigned to the assignee of the present invention. Reference may be had to these patents for detailed descriptions of components referred to herein other than the instant invention producing structural relationships in accordance with the invention. In addition, the attack/decay envelope address generator of the present invention as it relates to frequency synthesization and key assignment logic is described in U.S. Pat. No. 3,610,805, which is also assigned to the assignee of the present invention. Reference may also be had to this patent for detailed descriptions of component referred to herein other than the instant invention producing similar structural relationships in accordance with the invention.

In FIG. 1, there is shown a set of keys or key switches 10 making up the keyboard of the electronic musical instrument. The key switches 10 are used in the generic sense and will be referred to herein as keys, being the keys of various electronic musical instruments. The activity of the keys, the actuation or depression and release thereof, is encoded in a time-division multiplexed format in accordance with the teachings of U.S. Pat. No. 3,610,799. The time-division multiplexed signal proceeds to a frequency synthesizer 12 which generates a frequency number N corresponding to the actuated key. The frequency number N is generated in a serial format and proceeds to note generator 14. Note generator 14 denotes a number of note generators in accordance with the teachings of the previously mentioned patent. However, it is to be understood that the number of note generators could be limited to one if only a single note is required to sound at a time. The frequency synthesizer 12 also generates a timing pulse, BT, which is used for internal timing functions in the note generators. The internal timing functions in the note generators refer to the twelve microsecond time slots allotted to each multiplexed channel, each channel corresponding to a note generator. Frequency synthesizer 12 also supplies keyboard division, octave and note information along lines 16 to the key assigner 18. Key assigner 18 generates a claiming pulse, FGAT, for claiming any one of the note generators in note generator 14 in accordance with the internal timing functions. Frequency synthesizer 12, note generator 14, and key assigner 18 are each controlled by a master system clock, MCLK. For a more detailed explanation of the interrelationship of these devices, reference should be made to the above-listed patents which descriptions are incorporated herein by reference.

The note generator 14 generates an address which is transmitted to each of the memories, A & B, to provide the correct memory location to be read out within the multiplexing scheme of the keyboard musical instrument. An appropriately chosen output line of the address from note generator 14 is used to control the attack/decay rate which will be described more fully hereinafter.

Concurrently with the generating of a memory address from note generator 14, the key assigner 18 generates a read command to the voice selection control 20. The voice selection control 20 senses which of the stop tab switches 22 are selected and generates an address to memories A & B which designate the memory locations of a specific voice or voices in accordance with the setting of the stop tab switches 22. The memory address from the voice selection control 20 is generated simultaneously with the memory address from the note generator 14. In this manner, which is in accordance with the teachings of the previously referenced patents, the information from the desired memory locations is read out of each of the memories A & B.

The key assigner 18 also generates two additional signals. These are a clear pulse signal, CLRP, and an attack transient detection signal, ATK. These signals will be described more fully hereinafter.

In the embodiments of the present invention the least significant address bit generated by the note generator 14 is used as one of the two inputs to the attack/decay rate source switch 24. However, any one of the address bits generated by note generator 14 may be used as a pulse rate input to switch 24. The choice of which address bit to use depends on its recurrence rate and whether it is desirable to have a faster or slower rate, the least significant bit line having the fastest rate. The switch 24 may be an electronic switch or any other type switch of similar configuration known to one skilled in the art. The least significant address bit, which is applied to the S1 input of the attack/decay rate source switch 24, provides a fixed rate source, proportional to the frequency of the key being depressed, for the attack-/decay envelope address generator 26. An adjustable rate source 28 is attached to the rate source switch 24 at S2. The adjustable rate source 28 comprises a count source which may be a 555 timer, a voltage controlled oscillator, or an equivalent thereto such as can be constructed by one skilled in the art and a variable electrical resistive device for regulating the pulse rate of the count source. It is preferred that a 555 timer be used whose pulse rate is regulated by the variable potentiometer 30. The attack/decay rate source switch 24 controls the source of the pulse rate to the attack/decay envelope address generator 26. The switch 24 is maintained in its fixed rate source input state by resistor R1 which is connected to a logical "0." A switch 32, which may be either a separate switch or included as part of one of the special effect stop tab switches, when closed, effects the switching of the attack/decay rate source switch 24 from its S1 input to its S2 input. The switch 32 is connected at one end to the switch 24 and at its other end to the logical "1." A more detailed explanation of the internal workings and interrelationship of those components to the attack/decay rate source switch 24 is described in the co-pending patent application mentioned above. Thus, the rate source for the attack/decay envelope address generator 26 from output S0 of the rate source switch 24 is controlled by the switch 32.

The attack/decay envelope address generator 26 provides for the reading out of an address based on the count of a counter included in the envelope address generator 26. The count rate is determined by either one of the sources of rate source switch 24. The envelope address generator 26 functions in a multiplexed manner in accordance with the above-mentioned patents wherein it has as many channels as there are note generators in note generator 14. The clear pulse, CLRP, generated by key assigner 18, functions to reset the counter of the envelope address generator to zero on the channel corresponding to its occurrence in the multiplexed timing scheme. For a more detailed explanation of the interrelationship of the envelope address generator, reference should be made to U.S. Pat. No. 3,610,805, which description is incorporated herein by reference.

The address from the attack/decay envelope address generator 26 contains seven bits which are transmitted to an up/down count control 34. The transient attack detection signal, ATK, generated by key assigner 18 is sensed by the up/down count control 34 so that when the ATK signal is present, the count control 34 permits an increasing count, and when the ATK signal is absent, the count control permits a decreasing count. Reference should be made to the above-identified co-pending patent application for a detailed description of the components comprising the up/down count control 34 which is incorporated herein by reference.

As described in the co-pending patent application, the memories A & B would have received, as coded transient zone addresses, the three most significant bits from the output of the up/down count control 34. In the present invention the memories A & B receive the three coded zone addresses from the harmonic transient zone sequencer or address processor 36. The harmonic transient zone sequencer or address processor 36 and the harmonic transient zone sequence selector 38 will be described more fully hereinafter. Further, as described in the co-pending patent application, DAC C would have received the four least significant outputs from the up/down count control 34. The interconnection of the harmonic transient zone sequencer 36 to DAC C will be described immediately following.

The four least significant bits from the harmonic transient zone sequencer 36 are connected to the four most significant bit inputs of DAC C. The four least significant bits of DAC C are connected to ground so as not to interfere with the operation of DAC C. DAC C is a multiplying digital to analog converter similar to analog devices AD7523. The outputs of such devices have currents which are proportional to the product of its digital input code and its analog reference voltage. The outputs of DAC C are fed into the inverting and non-inverting inputs of an operational amplifier with the output of the amplifier in a feedback loop to the DAC. A Schottky diode is placed across the inputs of the operational amplifier to protect the DAC by preventing its failure during start-up. The configuration is a standard current to unipolar voltage scheme recommended by the DAC manufacturer. The interconnection of these components is described in detail in the co-pending patent application which is incorporated herein by reference. The reference voltage applied to DAC C has a positive value which will be discussed hereinafter. The output of DAC C and, therefore, the voltage reference input to DAC B will vary in accordance with the value of the input to DAC C from the harmonic transient zone sequencer 36 and the voltage present at the voltage reference to the DAC.

The entire output of the up/down counter control 34 is applied to the input of the attack/decay envelope shaping memory 44. The envelope shaping memory 44 is also connected to the ATK signal line so that either an attack type envelope or a decay type envelope may be generated depending on the presence or absence of the ATK signal. The output of the attack/decay envelope shaping memory 44 will be discussed in connection with the operation of DAC D.

The three most significant bits of the harmonic transient zone sequencer 36 complete the memory address for each of the memories A & B. Memory A contains harmonic transient structures for a preselected number of voices which are accessed and read out of the memory according to the addresses received from the voice selection control 20, note generator 14, and the harmonic transient zone sequencer 36. Memory B is accessed in the same manner as memory A and contains in its memory locations difference values which will be more fully described hereinafter. The memories A, B are read only memories, ROMs, structured in sections according to voice. Each of the voice sections is divided into a number of transient harmonic zones with each zone containing a number of waveform sample points having a fixed number of bits. While it was described in the co-pending patent application that eight zones would be preferable, any number of zones may be used with the only constraint on the number of the zones being the size of the memory.

Each zone in memory A contains a discrete fixed harmonic structure representing the tone color of an organ voice at a preselected time during the transient period of the waveform. This transient period being either the attack period or the decay period for that voice. The sequence of the transient harmonic structures read out of the zones of the memory during a transient period is controlled by the three most significant bits of the harmonic transient zone sequencer 36. If the ATK signal is present, the up/down count control 34 provides an increasing count to the harmonic transient zone sequencer 36 which in turn provides a three bit address for addressing the zones of memory A in ascending sequence. If the ATK signal is absent, then a decay transient period is detected and the up/down count control 34 inverts its count providing a decreasing address to the harmonic transient zone sequencer 36 which in turn provides the address to memory A in descending sequence. Thus the information contained in the zones of memory A are read out in reverse fashion. It should be noted that the ATK signal is present during both the attack transient time and the steady state harmonic period and absent during a decay transient time.

Memory B is structured in the same manner as memory A, preferably containing eight zones. The information contained in each zone is the algebraic difference between the discrete harmonic structures found in two adjacent zones of memory A. The sequencing of the zones in memory B is identical and simultaneous to the sequencing of the zones of memory A by virtue of similar address consisting of the three most significant bits from the output of the harmonic transient zone sequencer 36.

The outputs from the memories A & B are connected to the inputs of DAC A and DAC B respectively. DAC A is a multiplying digital to analog converter similar to analog devices AD7523 those output currents are proportional to the product of its digital input and its analog reference voltage input. The reference voltage for DAC A is determined by the value of resistors R2, R3 and a supply voltage, +V. The supply voltage to the reference voltage input of all of the digital/analog converting devices of the invention has been chosen in accordance with the manufacturer's recommendation of a range between +10 volts and −10 volts. It is preferred that the supply voltage +V be in the range of +5 volts to +10 volts. DAC B is also a multiplying digital to analog converter similar to the AD7523 where the reference input voltage varies with time. The reference voltage input to DAC B is the output of current to voltage converter 42 from DAC C which varies between zero and its full scale value which is equal to the reference voltage input applied to DAC C. DAC C varies over this range in steps according to the digital code applied to its input by the four least significant bits from the harmonic transient zone sequencer 36. The correlation between the four least significant and the three most significant bits from the output of the harmonic transient zone sequencer 36 permit the output of DAC B to vary over its full range once for each zone in the memories A & B.

The outputs of DAC A and DAC B are supplied to summing means 46 where the output currents of both DAC A and DAC B are added and converted to a voltage. The configuration of summing means 46 is a standard current to bipolar voltage scheme recommended by the manufacturer. By its very nature this configuration performs a current summing function familiar to those skilled in the art. Reference should be made to the above-referenced co-pending patent application for a more detailed explanation of the interconnection of the summing means 46 and DAC A, DAC B, and DAC D, which description is incorporated herein by reference.

The output of summing means 46 is used as the voltage reference input to DAC D, another multiplying digital to analog converter similar to the AD7523. The digital input to DAC D comes from the attack/decay envelope shaping memory 44 in the form of a seven bit address. The attack/decay envelope shaping memory is a read only memory, ROM, in which an attack or decay envelope shape is stored as the sampled waveform. The envelope shaping memory 44 is organized in two sections. The memory 44 is a seven x r bit device where either the attack or the decay section of memory is addressed depending upon the presence or absence of the ATK signal. The memory location address for the envelope shaping memory 44 is the entire output of the up/down count control 34. DAC D accepts seven input lines from the envelope shaping memory 44 having the least significant bit connected to ground. As in the case of the other multipling digital to analog converters, the interconnection of the circuit devices at the output of DAC D is more fully described in the above-referenced co-pending patent application and is incorporated herein by reference. The circuit configuration described is a standard current to unipolar voltage scheme recommended by the digital to analog converting device manufacturer which is familiar to those skilled in the art.

DAC D performs the function of combining the interpolated transient harmonic structures with the appropriate transient period envelope. Thus, the output of DAC D is the product of the transient harmonic structure interpolation sequence and the transient or attack period envelope, respectively. The output current from DAC D is fed into the current to voltage converter 48 which is comprised of similar elements to the current to voltage converter 42 and described in the above-referenced co-pending patent application which description is incorporated herein by reference. The output from the current to voltage converter 48 is fed into audio amplifier 50. The output of audio amplifier 50 goes to a standard sound transducing device such as a speaker 52 which creates the audible sound of the selected voices corresponding to the actuated keys of the electronic musical instrument.

Referring again to FIG. 1, and also referring to FIG. 2, the output lines of the up/down count control 34 are connected in parallel to both the attack/decay envelope shaping memory 44 and the harmonic transient zone sequencer 36. The harmonic transient zone sequencer 36 may be one of many different physical configurations of hardware as those skilled in the art may interconnect, but it is preferred that the following two embodiments be used with the present invention. In the first embodiment the harmonic transient zone sequencer 36 comprises two address processors 1, 2 for controlling the addresses to the memories A, B and DAC C. From FIG. 1 it can be seen that the memories A and B receive as part of the overall address three lines containing the coded zone address from the harmonic transient zone sequencer 36. In the embodiment of the invention using the address processors the five most significant output lines from the up/down count control 34 are provided to the inputs to address processor 1. The most significant bit of the count from the up/down count control 34 is connected to the $X_1$ input of the electronic switch 54; the $X_0$ input of the switch 54 is connected to a positive voltage, +V, having a value of +5 V. The most significant bit line which is connected to the $X_1$ input of switch 54 is also connected to the $Y_0$ input of switch 54. The $X_2$ input of switch 54 is connected to the most significant bit and the second most significant bit of the up/down count through AND gate 56. The second most significant bit is also connected to the $Y_1$ input of switch 54 and the $X_0$ of electronic switch 58. The third most significant bit from the up/down count control 34 is connected to the $Y_2$ input of the switch 54 and to the $X_1$ and $Y_0$ inputs of switch 58. The fourth most significant bit of the up/down count is connected to the $X_2$ and $Y_1$ inputs of switch 58, and the fifth most significant bit is connected to the $Y_2$ input of switch 58. These electronic switches 54, 58 are standard dual 4 to 1 multiplexers having an industry designation number 4052. Address processor 2 is connected to the up/down count control 34 in the following manner. The fourth most significant bit of the up/down count is connected to the $X_0$ input of an electronic switch 60. The fifth most significant bit is connected to the $X_1$ and $Y_0$ inputs of switch 60. The sixth most significant bit is connected to the $X_2$ and $Y_1$ inputs of switch 60 and the $X_0$ input of electronic switch 62. The least significant bit of the up/down count is connected to the $Y_2$ input of switch 60 and the $X_1$ and $Y_0$ inputs of switch 62. The $X_2$, $Y_1$ and $Y_2$ inputs of switch 62 are connected to ground. As in the electronic switches described above, switches 60 and 62 and standard dual 4 to 1 multiplexers having an industry designation of 4052. The remaining inputs in the X and Y fields of each of the switches 54, 58, 60 and 62 have no connections as there are only three harmonic interpolation sequences provided in this first embodiment of the present invention.

Returning to address processor 1, the X output is connected to one input of each of the AND gates 64, 66, 68, 70, 72, 74 and 76. The other inputs of the AND gates 64–76 are connected as follows. The second input of AND gate 64 is connected to the Y output of switch 54. The second input of AND gate 66 is connected to the X output of switch 58, and the second input of AND gate 68 is connected to the Y output of switch 58. The second inputs of AND gates 70 and 72 are connected to the X and Y outputs, respectively, of switch 60. The second inputs of AND gates 74 and 76 are connected to the X and Y outputs, respectively, of switch 62. The outputs of AND gates 64, 66 and 68 comprise the three zone address lines to memories A and B. The outputs of AND gates 70, 72, 74 and 76 comprise the four inputs to DAC C.

Figure 3:
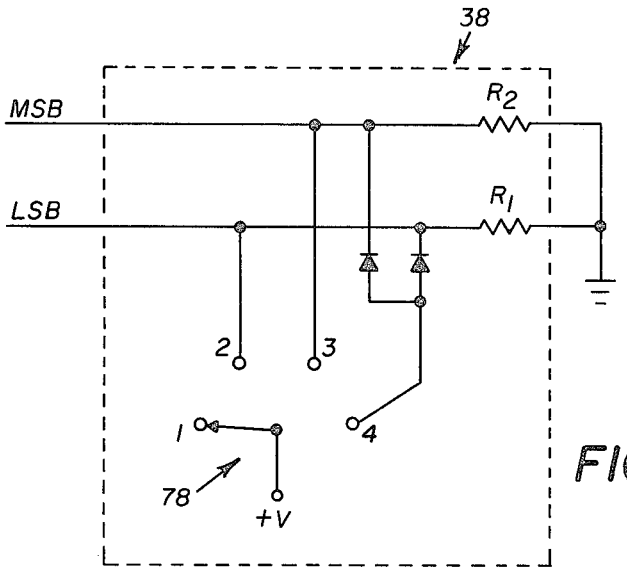
FIG. 3 is a schematic diagram of the sequence selector of the present invention.

Each of the electronic switches 54, 58, 60 and 62 has its switching function controlled by the sequence selector 38 over the lines interconnecting these elements labelled MSB and LSB. A schematic of the sequence selector 38 is shown in FIG. 3 where a rotary switch 78 controls the binary output code over two lines (MSB/LSB) to the address processors 1 and 2. The relationship of the binary code to the harmonic transient zone sequencing will be discussed fully hereinafter. The switch 78 may be of the rotary type, as shown in FIG. 3, or any other electro-mechanical configuration which is capable of serving the same function as presently known to those skilled in the art. The switch 78 is connected to a positive voltage which is switched from one to any of the other outputs of the switch 78 to control the zone sequencing by means of the binary code from the sequence selector 38. As is shown in the drawing, position 1 of switch 78 stands unconnected. Position 2 of switch 78 (the least significant bit of the binary code, LSB) is one output of the selector 38 which is connected through resistor R1 to ground. Position 3 of the switch 78 is connected to the second output line (the most significant bit of the binary code, MSB) which is connected through a resistor R2 to ground. The resistors serve the purpose of providing a binary code of 00 from the selector 38 when switch position 1 is selected. Switch position 4 is connected to both the LSB and MSB output lines of the selector 38 by industry standard glass diodes in order to prevent the incorrect energizing of one line or the other when switch positions 2 or 3 are selected. Different harmonic interpolation sequences have been selected which correspond to the binary code on the output lines of the selector 38, which sequences are listed below with their corresponding binary code and switch position in the table.

SEQUENCE SELECTION TABLE

| Switch Position | Binary Code MSB/LSB | Sequence |
|---|---|---|
| 1 | 00 | Full period linear |
| 2 | 01 | Half period linear |

-continued

SEQUENCE SELECTION TABLE

| Switch Position | Binary Code MSB/LSB | Sequence |
|---|---|---|
| 3 | 10 | Quarter period linear |
| 4 | 11 | Full period non-linear (Second embodiment only) |

Figure 4:
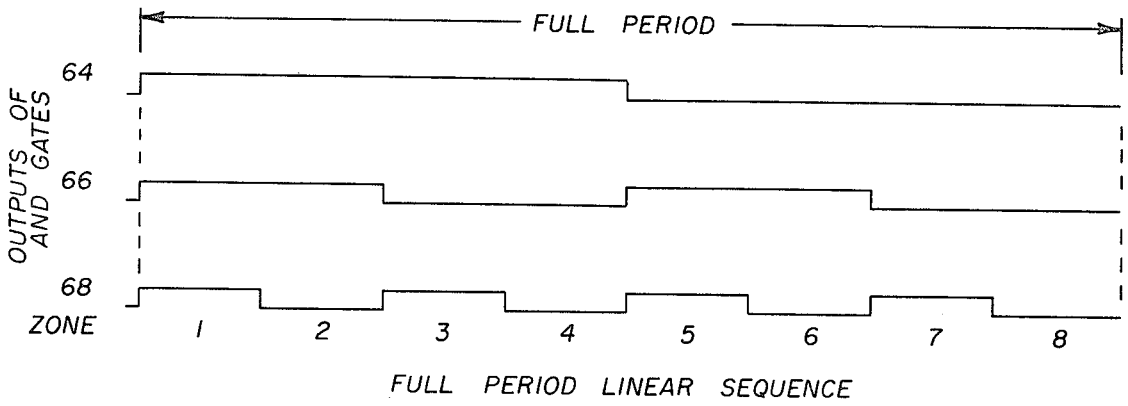
FIG. 4 is a graph representing a full period linear sequence of the harmonic interpolation during a transient period of a reproduced tone.
Figure 5:
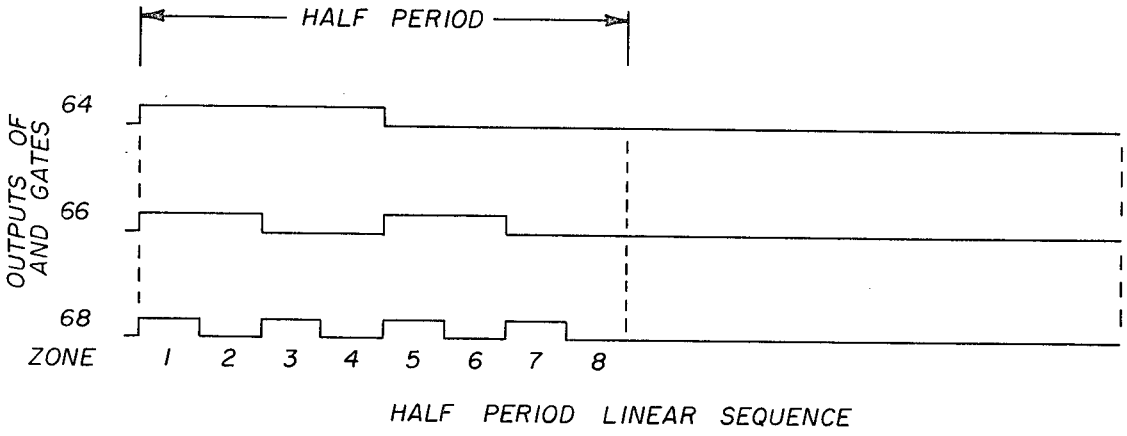
FIG. 5 is a graph representing a half-period linear sequence of the harmonic interpolation during the transient period of a reproduced tone.
Figure 6:
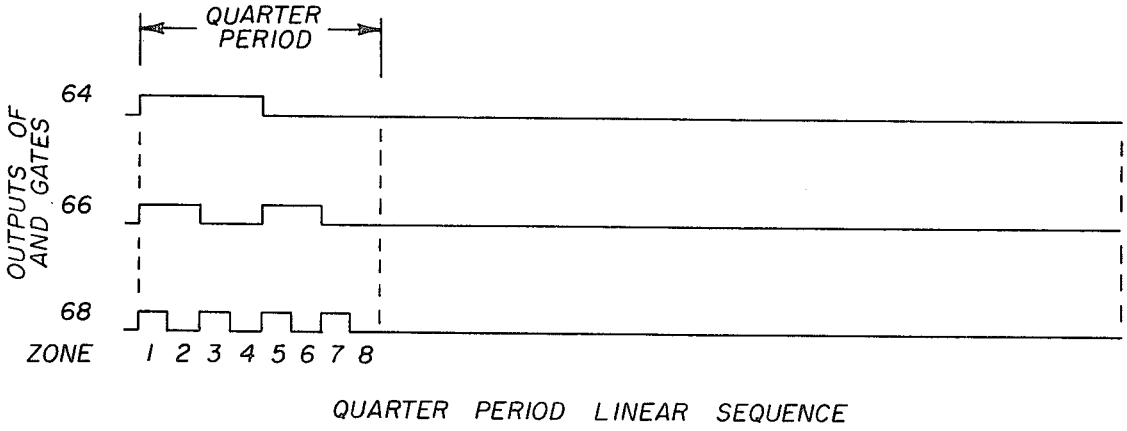
FIG. 6 is a graph representing a quarter-period linear sequence of the harmonic interpolation during the transient period of a reproduced tone.

The output of the selector 38 is applied to the zone selection inputs of both address processor 1 and address processor 2. The binary code on the zone selection lines cause the input to electronic switches 54, 58, 60 and 62 to be selectively placed on the outputs of AND gates 64–76. FIGS. 4, 5 and 6 show the output timing of address processor 1 to memories A and B for the three operating modes corresponding to the selector switch 78, positions 1, 2 and 3. These modes are:

1. Harmonic interpolation over the entire transient period;
2. Harmonic interpolation over the first half of the transient period, the second half of the period being harmonically static; and
3. Harmonic interpolation over the first quarter of the transient period, the remaining three quarters of the period being harmonically static.

Since the inputs to address processor 1 continue throughout the full transient period, AND gates 64, 66 and 68 are necessary to inhibit further action of the harmonic interpolation process in modes two and three. AND gate 56 is used to generate an inhibit function over line 80 while in mode 3. In mode 2 the most significant bit of the up/down count control 34 provides the inhibit function. Since the interpolation portion of the transient period has been shortened in modes 2 and 3, the remaining portion of the transient period should exhibit no change in harmonic structure but only a change in envelope amplitude. Thus, the need to inhibit further interpolation of harmonic structure of the waveforms.

Figure 8:
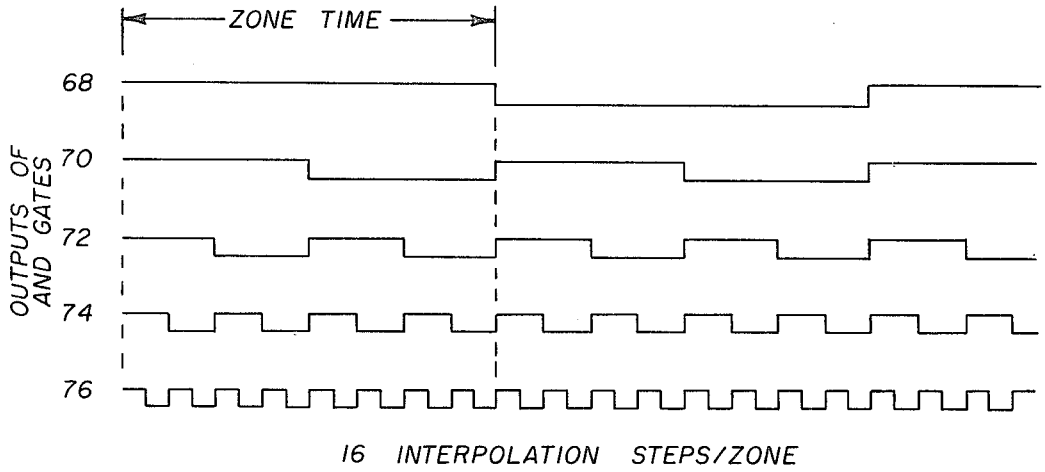
FIG. 8 is a graph showing sixteen interpolation steps for a single zone time period.
Figure 9:
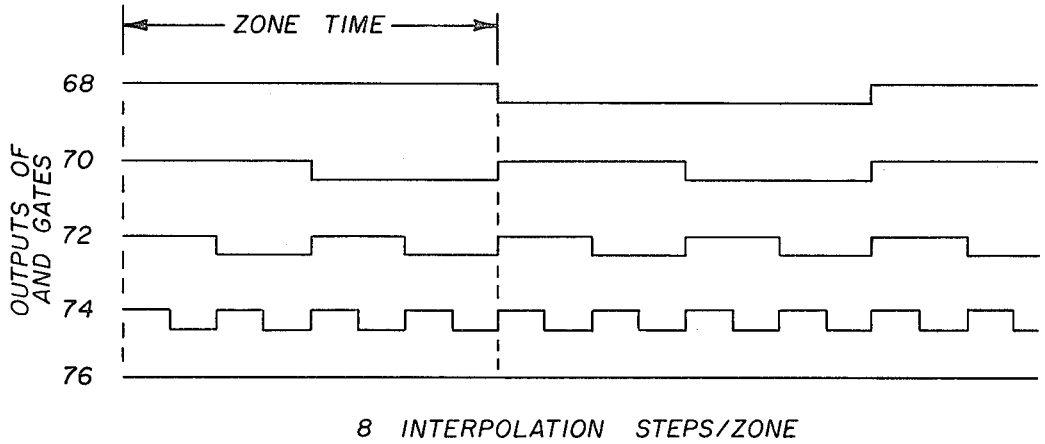
FIG. 9 is a graph showing eight interpolation steps for a single zone time period.
Figure 10:
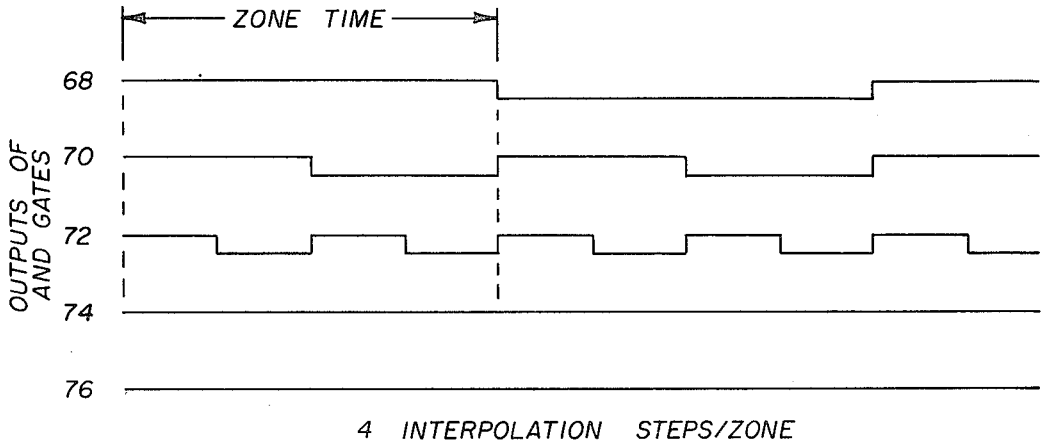
FIG. 10 is a graph showing four interpolation steps for a single zone time period.

In the present invention the input lines to DAC C, which are key factors in the harmonic interpolation process, come from the output of address processor 2 rather than directly from the four least significant outputs of the up/down count control 34. The address processor 2, as described above, is similar in concept and design to address processor 1. It should be noted that in mode 1 all four outputs of address processor 2 are active, thus yielding sixteen interpolation steps for each harmonic zone. In mode 2 the output of AND gate 76 becomes inactive yielding eight interpolation steps for each harmonic one. Both of the outputs of AND gate 74 and 76 will become inactive in mode 3 yielding four interpolation steps for each harmonic zone. FIGS. 8, 9 and 10 show the output timing relationships of address processor 2 for each of the three modes. Note that for each mode of operation the four outputs of AND gates 70–76 are shown in relation to the corresponding output of AND gate 68 of address processor 1. It should be also be noted that although the period or zone time of the output of AND gate 68 has been drawn to substantially the same scale, the period or zone time of the output of AND gate 68 in mode 2 is actually one-half of its output in mode 1 and one-quarter of its output in mode 3. This relationship can be seen more clearly with reference to FIGS. 4, 5 and 6.

Summarizing the effect of the address processors 1 and 2 on the harmonic interpolation, it can be seen from FIGS. 4, 5 and 6 that the full eight zone harmonic interpolation is reduced from the total transient period to half and quarter periods respectively. It can also be seen from FIGS. 8, 9 and 10 that the number of interpolation steps for transient zone as each zone relates to the different modes of operation are 16, 8 and 4, respectively, for modes 1, 2 and 3. The net result is that the degree of harmonic change per unit time can be increased without having to increase the size of the harmonic waveform memories A and B. Although this explanation has been limited to the stimulation of certain percussive sounds which have the greater amount of harmonic change in their decay transient waveforms, it is conceivable that a similar technique could be used to limit the harmonic interpolation period during the attack transient waveform through the last half or quarter of the period, a time which is more noticeable to the listener because of its audible level.

The second embodiment of the present invention uses a read-only memory, ROM, or an erasable programmable memory, EPROM, for the harmonic transient zone sequencer 36. These type memories are used because their different memory locations can be divided into regions which are capable of storing unique harmonic change sequences. The desired sequence is selected by the sequence selector 38 which generates a two bit binary code to the harmonic transient zone sequencer 36 as described above. Further, in this embodiment of the present invention, the fourth mode, the non-linear sequence, is used. The harmonic change sequence contained in each region of the sequencer 36 provides, on the three most significant output lines, the harmonic zone address sent to the waveform memories A and B. On the four least significant outputs of the sequencer 36 are found the harmonic interpolation step information for each zone which are used as inputs to DAC C. Reference should be made to FIGS. 4, 5 and 6 for the relationships of the full, half and quarter period linear sequences which correlate exactly to the outputs of address processor 1 of the first embodiment of the present invention. It is to be remembered that FIG. 4 depicts a linear sequence over the entire transient period and is the sequence generated in the patent application mentioned above. FIGS. 5 and 6 represent linear harmonic change over half and quarter periods of the entire transient period, respectively. In each of the sequences the nature of the tone color for the remaining period of the overall transient period would remain constant with only a change in the envelope amplitude.

Figure 11:
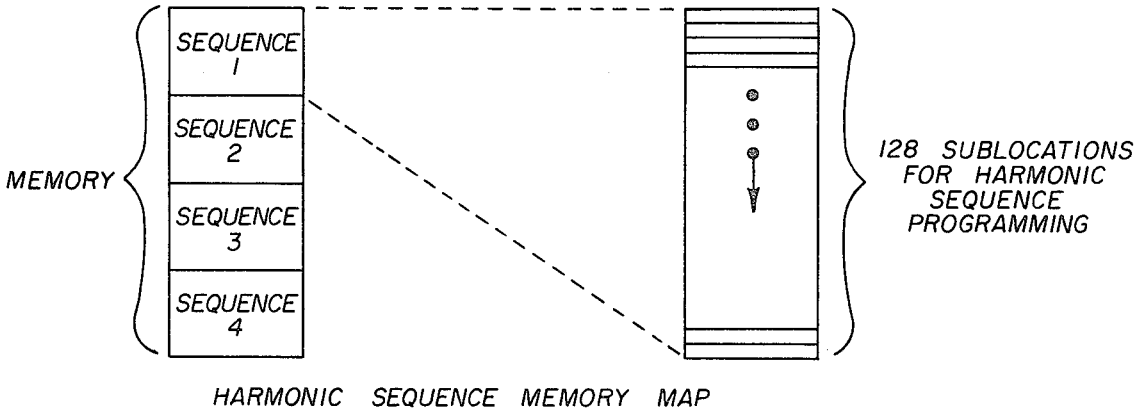
FIG. 11 is a graphical representation of the configuration of another embodiment of the address processing unit of the present invention comprising a memory.

The sequence selector 38 provides the harmonic transient zone sequencer 36 in this embodiment with a two-bit binary code, as described above, to differentiate between modes or sequences. An additional mode or sequence has been added such that with the use of a memory, a ROM or an EPROM, it is possible to achieve a non-linear harmonic change during a transient period. Referring to FIG. 11, there is shown a memory divided into regions designated sequence 1 through sequence 4. Within each sequence region are 128 sublocations for harmonic sequence programming. Each sublocation of the region contains a transient zone address and the associated interpolation information. This is because the output of the harmonic transient zone sequencer 36 has its three most significant bits directed to memories A and B to complete the address of those memories and its four least significant bits directed to DAC C for use in the interpolation of the harmonic information contained in memories A and B. It should be understood that the outputs of the harmonic transient zone sequencer 36, or rather the outputs of the embodiment of the sequencer 36 configured in either a ROM or an EPROM, are identical to the outputs of the sequencer configured as address processors 1 and 2. Therefore, the graphs of FIGS. 4, 5 and 6, which show the output of the address processor 1, also shows the output of the three most significant bits of the memory means of the second embodiment of the harmonic transient zone sequencer 36. The output of address processor 2 to DAC C is graphically shown in FIGS. 8, 9 and 10. The outputs of AND gates 70–76 are equivalent to the outputs of the four least significant bits of the memory means of the sequencer 36 and are shown in these figures in comparison with the third most significant bit (output of AND gate 68). The foregoing discussion holds true for the second embodiment of this invention using a memory means as it did for the first embodiment of this invention using the address processor configuration.

Figure 7A:
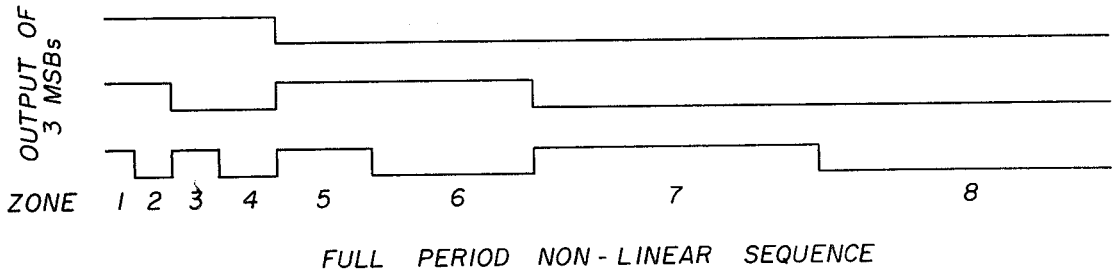
FIG. 7A is a graph representing a full period non-linear sequence of the harmonic interpolation during the transient period of a reproduced tone.
Figure 7B:
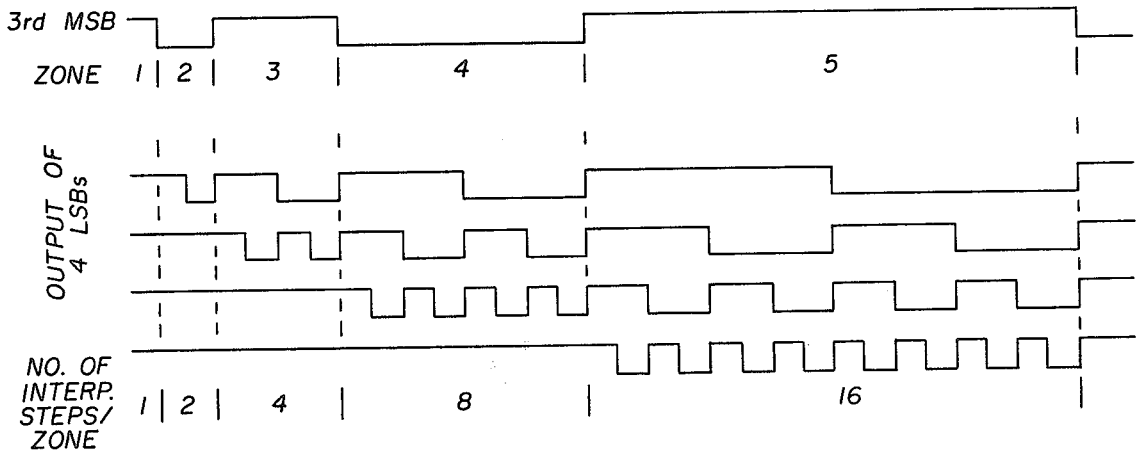
FIG. 7B is a graph comparing the number of interpolation steps per zone for a portion of the non-linear sequence shown in FIG. 7A.

In addition to the three modes of operation which are capable of using the address processor embodiment, the memory embodiment of the present invention also is capable of providing non-linear harmonic change over an entire transient period. Referring to FIGS. 7A and 7B, it is shown that over an entire eight zone transient period the harmonic change is greatest at the beginning and gradually decreases with time. This is true for either an attack or a decay transient period. This structure allows for the rapid changes in the harmonic structure at the onset of the change in the tone while providing for a lesser degree of that change throughout the remainder of the transient period. FIG. 7B shows the comparison between the third most significant bit of the memory means of the sequencer 36 and the output of the four least significant bits of the memory means showing the number of interpolation steps per zone. It should be noted that there are an increasing number of interpolation steps per zone until 16 steps per zone are reached, and then a constant number of steps per zone, 16 steps, is maintained. [FIG. 7A depicts equivalent information to that of FIGS. 4, 5 and 6; FIG. 7B depicts equivalent information to FIGS. 8, 9 and 10; showing the outputs of the harmonic transient zone sequencer 36 in the several different modes of operation.] The number and nature of the harmonic change in a non-linear sequence can vary in accordance with the specific requirements of the tone or the choice of the organ designer.

The present invention provides for different modes of operation in order to control and/or vary harmonic change over an entire transient period of a tone. In accomplishing this, the present invention provides for either a fixed variation by shortening the interpolation portion of the transient period by providing fixed length interpolation for that shortened period. Further, the present invention provides for a non-linear harmonic sequence over the entire transient period by use of a memory device programmed in accordance with the type of effect sought to be achieved by the organ designer. Thus, the present invention provides a means for varying or tailoring the rate of harmonic change over the entire transient period to achieve a more realistic effect as the resulting tone varies during the transient period.

The present invention may be embodied in other specific forms without departing from the spirit or essential attributes thereof and, accordingly, reference should be made to the appended claims, rather than to the foregoing specification as indicating the scope of the invention.

I claim:

1. In an electronic musical instrument having a greater number of selectively actuable switches than note generators to cause the production of sounds corresponding to the respective notes of a musical scale, an apparatus for interpolating between harmonic structures of a waveform stored in memory during portions or the entire transient periods of said waveform comprising:

at least first and second memories having a number of locations or zones in each memory, said number of zones being equivalent to the number of harmonic structures;

a fixed harmonic structure in each zone of the first memory;

a difference value in each zone of the second memory, said difference value equal to the difference between the fixed harmonic structures in adjacent zones of the first memory;

means for controlling the length of time of the interpolation between harmonic structures of a waveform during the transient periods of said waveform by generating addresses for selectively causing the reading out from each said memory the contents of each zone in accordance with the output of said means for controlling the length of time of the interpolation, said zone address being the upper segment of the output, for selectively controlling the scaling of the difference values read out from each zone of said memory by a digital to analog converting means, said digital to analog converting means address being the lower segment of the output;

means for converting and scaling the fixed harmonic structure read out of a selected zone of the first memory having a scaling factor being a fixed value;

means for converting and scaling the difference value read out of a selected zone of the second memory having a scaling factor varying in accordance with the lower segment of the output;

summing means for combining the converted and scaled fixed harmonic structures read out of the selected zones of the first memory with the converted and scaled difference values read out of the selected zones of the second memory and generating an output;

means for converting and scaling the generated transient waveform envelope having a scaling factor in accordance with the generated output of the summing means; and, amplifying means for producing the interpolated transient harmonic structures of the waveform as sound through an audio transducing means.

2. In accordance with claim 1 wherein said means for controlling the length of time of the interpolation between harmonic structures of a waveform comprises:

means for detecting the transient period of the harmonic structure of a waveform, said transient period being either the attack or decay period;

means for generating either a monotonically increasing address during an attack period or a monotonically decreasing address during a decay period; and, means for selectively controlling the sequence of the interpolation between harmonic structures of the waveform during the transient periods.

3. In accordance with claim 2 wherein said means for selectively controlling the sequence of the interpolation between harmonic structures of the waveform comprises:

a switching means for generating a control code, said control code designating the selected sequence of interpolation; and, an address processing means for interpreting the generated address and selectively controlling the memory zone address and the digital to analog converting means address in accordance with said sequence control code.

4. In accordance with claim 3 wherein said control code is a two bit binary code.

5. In accordance with claim 2 wherein said means for selectively controlling the sequence of the interpolation between harmonic structures of the waveform comprises:

a switching means for generating a control code, said control code designating the selected sequence of interpolation; and, a separate storage means for interpreting the generated address and selectively controlling the memory zone address and the digital to analog converting means address in accordance with said sequence control code.

6. In accordance with claim 5 wherein said control code is a two bit binary code.

7. In accordance with claim 1 wherein said upper segment of the output of said means for controlling the length of time of the interpolation comprises the three most significant bits of said output.

8. In accordance with claim 1 wherein said lower segment of the output of said means for controlling the length of time of the interpolation comprises the four least significant bits of said output.

9. In an electronic organ having a greater number of selectively actuable switches than note generators to cause the production of sounds corresponding to the respective notes of a musical scale, an apparatus for interpolating between harmonic structures of a waveform stored in memory during portions or the entire transient periods of said waveform comprising:

at least first and second memories having a number of locations or zones in each memory, said number of zones being equivalent to the number of harmonic structures;

a fixed harmonic structure in each zone of the first memory;

a difference value in each zone of the second memory, said difference value equal to the difference between the fixed harmonic structures in adjacent zones of the first memory;

means for controlling the length of time of the interpolation between harmonic structures of a waveform during the transient periods of said waveform by generating addresses for selectively causing the reading out from each said memory the contents of each zone in accordance with the output of said means for controlling the length of time of the interpolation, said zone address being the upper segment of the output, for selectively controlling the scaling of the difference values read out from each zone of said memory by a digital to analog converting means, said digital to analog converting means address being the lower segment of the output;

means for converting and scaling the fixed harmonic structure read out of a selected zone of the first memory having a scaling factor being a fixed value;

means for converting and scaling the difference value read out of a selected zone of the second memory having a scaling factor varying in accordance with the lower segment of the output;

summing means for combining the converted and scaled fixed harmonic structures read out of the selected zones of the first memory with the converted and scaled difference values read out of the selected zones of the second memory and generating an output;

means for converting and scaling the generated transient waveform envelope having a scaling factor in accordance with the generated output of the summing means; and, amplifying means for producing the interpolated transient harmonic structures of the waveform as sound through an audio transducing means.

10. In accordance with claim 9 wherein said means for controlling the length of time of the interpolation between harmonic structures of a waveform comprises:

means for detecting the transient period of the harmonic structure of a waveform, said transient period being either the attack or decay period;

means for generating either a monotonically increasing address during an attack period or a monotonically decreasing address during a decay period; and, means for selectively controlling the sequence of the interpolation between harmonic structures of the waveform during the transient periods.

11. In accordance with claim 10 wherein said means for selectively controlling the sequence of the interpolation between harmonic structures of the waveform comprises:

a switching means for generating a control code, said control code designating the selected sequence of interpolation; and, an address processing means for interpreting the generated address and selectively controlling the memory zone address and the digital to analog converting means address in accordance with said sequence control code.

12. In accordance with claim 11 wherein said control code is a two bit binary code.

13. In accordance with claim 10 wherein said means for selectively controlling the sequence of the interpolation between harmonic structures of the waveform comprises:

a switching means for generating a control code, said control code designating the selected sequence of interpolation; and, a separate storage means for interpreting the generated address and selectively controlling the memory zone address and the digital to analog converting means address in accordance with said sequence control code.

14. In accordance with claim 13 said control mode is a two bit binary code.

15. In accordance with claim 9 wherein said upper segment of the output of said means for controlling the length of time of the interpolation comprises the three most significant bits of said output.

16. In accordance with claim 9 wherein said lower segment of the output of said means for controlling the length of time of the interpolation comprises the four least significant bits of said output.

17. In an electronic musical instrument having a greater number of selectively actuable switches than note generators to cause the production of sounds corresponding to the respective notes of a musical scale, a method for interpolating between harmonic structures of a waveform stored in memory during portions or the entire transient periods of said waveform comprising the steps of:

providing at least first and second memories having a number of locations or zones in each memory, said number of zones being equivalent to the number of harmonic structures;

providing a fixed harmonic structure in each zone of the first memory;

providing a difference value in each zone of the second memory, said difference value equal to the difference between the fixed harmonic structures in adjacent zones of the first memory;

providing a means for controlling the length of time of the interpolation between harmonic structures of a waveform during the transient periods of said waveform by generating addresses for selectively causing the reading out from each said memory the contents of each zone in accordance with the output of said means for controlling the length of time of the interpolation, said zone address being the upper segment of the output, for selectively controlling the scaling of the difference values read out from each zone of said memory by a digital to analog converting means, said digital to analog converting means address being the lower segment of the output;

providing a means for converting and scaling the fixed harmonic structure read out of a selected zone of the first memory having a scaling factor being a fixed value;

providing a means for converting and scaling the difference value read out of a selected zone of the second memory having a scaling factor varying in accordance with the lower segment of the output;

providing a summing means for combining the converted and scaled fixed harmonic structures read out of the selected zones of the first memory with the converted and scaled difference values read out of the selected zones of the second memory and generating an output;

providing a means for converting and scaling the generated transient waveform envelope having a scaling factor in accordance with the generated output of the summing means; and, providing an amplifying means for producing the interpolated transient harmonic structures of the waveform as sound through an audio transducing means.

18. In accordance with claim 17 wherein said means for controlling the length of time of the interpolation between harmonic structures of a waveform comprises the steps of:

providing a means for detecting the transient period of the harmonic structure of a waveform, said transient period being either the attack or decay period;

providing a means for generating either a monotonically increasing address during an attack period or a monotonically decreasing address during a decay period; and, providing a means for selectively controlling the sequence of the interpolation between harmonic structures of the waveform during the transient periods.

19. In accordance with claim 18 wherein said means for selectively controlling the sequence of the interpolation between harmonic structures of the waveform comprises the steps of:

providing a switching means for generating a control code, said control code designating the selected sequence of interpolation; and, providing an address processing means for interpreting the generated address and selectively controlling the memory zone address and the digital to analog converting means address in accordance with said sequence control code.

20. In accordance with claim 19 wherein said control code is a two bit binary code.

21. In accordance with claim 18 wherein said means for selectively controlling the sequence of the interpolation between harmonic structures of the waveform comprises the steps of:

providing a switching means for generating a control code, said control code designating the selected sequence of interpolation; and, providing a separate storage means for interpreting the generated address and selectively controlling the memory zone address and the digital to analog converting means address in accordance with said sequence control code.

22. In accordance with claim 21 wherein said control code is a two bit binary code.

23. In accordance with claim 17 wherein said upper segment of the output of said means for controlling the length of time of the interpolation comprises the three most significant bits of said output.

24. In accordance with claim 17 wherein said lower segment of the output of said means for controlling the length of time of the interpolation comprises the four least significant bits of said output.

* * * * *